United States Patent [19]

Shimizu et al.

[11] Patent Number: 4,596,608

[45] Date of Patent: Jun. 24, 1986

[54] METHOD OF MANUFACTURING OF STEEL SHEET FOR EASY OPEN END CAN WITH SUPERIOR OPENABILITY

[75] Inventors: Keiichi Shimizu; Ryoichi Fukumoto, both of Yamaguchi, Japan

[73] Assignee: Toyo Kohan Co., Ltd., Tokyo, Japan

[21] Appl. No.: 723,462

[22] Filed: Apr. 15, 1985

[51] Int. Cl.[4] ..... C21D 7/10

[52] U.S. Cl. ..... 148/12 R; 148/12 C; 148/12 D; 148/12.1

[58] Field of Search ..... 148/12 C, 12 D, 12 R, 148/12.1

[56] References Cited

U.S. PATENT DOCUMENTS

| | | | |
|---|---|---|---|
| 3,139,359 | 6/1964 | Morgan | 148/12.1 |
| 3,285,790 | 11/1966 | Lockwood | 148/12.1 |
| 3,598,658 | 8/1961 | Matsukura et al. | 148/12.1 |

*Primary Examiner*—Wayland Stallard

*Attorney, Agent, or Firm*—Wenderoth, Lind & Ponack

[57] ABSTRACT

A method for manufacturing steel sheet for easy open end cans superior in openability comprising an improvement in the conventional process which includes the steps of hot rolling, first cold rolling, annealing and second cold rolling. The improvement resides in the operation of the second cold rolling reduction according to the formula: $100-0.08\times(C+1{,}000\times P)-0.8\times H>R>20$ and $45>R$. This formula expresses the relationship between hardness, carbon content and cleanliness after annealing, wherein R: second cold reduction (%)

C: carbon content after annealing (ppm)

P: cleanliness after annealing (d60×400 . . . %)

H: hardness after annealing (Hr 30T).

3 Claims, 2 Drawing Figures

METHOD OF MANUFACTURING OF STEEL SHEET FOR EASY OPEN END CAN WITH SUPERIOR OPENABILITY

BRIEF DESCRIPTION OF THE INVENTION

This invention relates to a method for manufacturing steel sheet for easy open end cans having superior openability.

In the relationship between hardness Hr30 T . . . per ASTM E18-61, the substance of which is incorporated by reference herein), cleanliness (d60×400% . . . per JIS G0555, the substance of which is incorporated by reference herein) and carbon content (ppm) after annealing which follows hot rolling and first cold rolling, in the process for manufacturing steel sheet for cans, the conditions for the second cold rolling reduction after annealing are to be determined, in order to produce a steel sheet for easy open end cans having high openability.

In recent years a variety of easy opening cans have been employed for food. In these cans, the can end panel has an adequate shape, is scored and a tab is attached to such scored can end panel so that the end of can can be opened with no use of an opener by pulling this tab. As the material for this type of easy opening can, aluminum sheet is generally used, mainly due to good openability. Steel sheet (tin plate or tin-free steel) is employed when the content of the can is a matter of consideration. However, since aluminum is relatively costly as compared with steel, development of an inexpensive, easy opening steel-made can has been earnestly demanded. To improve ease of can opening, namely, can openability, the following major two factors may be considered: one is thinning of residual metal thickness after scoring and the other is reducing the opening force without thinning of residual metal thickness. For the first factor, a residual metal thinning technique is a condition dependent on considerations such as cracks at the score, damage by impact when the can is dropped or by other accidents, or accuracy of pressing in scoring. These restrictive considerations prevent the residual metal thickness from being sufficiently thinned. For the second, an improvement in the opening force without changing the residual metal thickness has, as a matter of fact, not been successfully accomplished to date in spite of various controls imposed on the material properties. Under the circumstances, this invention has been developed as a result of extensive research with a view towards the achievement of considerable improvement in openability by resolving the foregoing two problems concurrently, that is, a method of manufacturing of steel sheet for easy open end cans which provides not only good openability without changing the residual metal thickness but also thinning of residual metal thickness as well.

DETAILED DESCRIPTION

This invention discloses that steel sheet for easy open end cans can be manufactured by an improvement in the conventional process for the manufacture of steel sheet for cans. This conventional process comprises hot rolling, first cold rolling, annealing and second cold rolling. By conducting the second cold rolling step according to the formulae $$100-0.08\times(C+1{,}000\times P)-0.8\times H>R>20 \ldots (1)$$

and $$45>R \ldots (2)$$

the desired results are obtained.

Formulae (1) and (2) are experimentally derived equations, where R is the second cold rolling reduction (%), C is carbon content (ppm), H is hardness (Hr 30T) and P is cleanliness (d60×400 . . . %). Hardness varies depending upon the annealing method (box annealing, continuous annealing), annealing conditions (temperature, heating and cooling rates) and composition of the steel, and in general it ranges from 40 to 65 in Hr 30T.

Carbon content can be controlled in the range less than 1,300 ppm (0.13%) in case of steel sheet for cans, depending upon the decarburization condition of molten steel, or presence or lack of decarburization annealing in the intermediate process.

Cleanliness, which depends upon the deoxidation process of molten steel and composition of steel, ranges from 0.01 to 0.8 generally.

In this respect, the basis on which the second cold rolling reduction conditions are determined, as above mentioned, derives from the result of in-depth studies and observations pertaining to the correlation of properties and openability of end materials, scoring technique, and strength, as will now be explained.

First of all, the relation between sheet thickness of the end material, yield stress and openability will be discussed.

If the sheet thickness of the end material is reviewed based on its yield strength, which is determined by the end sheet thickness squared times the yield stress of the end material, (when internal or external pressure applied exceeds this yield strength, the end will be deformed plastically), harder steels will be able to be better thinned.

It is the case, however, that even if two steels have the same yield strength, the harder and thinner one is more elastically deformed than the softer and thicker steel because elastic deformation is in proportion to steel thickness cubed.

Still further, the force applied to the end material is greater at the heating temperatures intended for pasteurization.

So, as high strength as can cause no plastic deformation at such time, that is, various combinations of steel thickness and yield stress may be discussed based on the yield strength of the end material if no regard is given to working elastic deformations.

The softer and thicker steel and the harder and thinner steel sheet with equivalent strength are then machined to have the same residual metal thickness after scoring for comparison of their openability.

The result shows that the harder and thinner steel sheet is lower in openability than the softer and thicker steel sheet.

This result disagrees with most estimates that the thicker steel sheet would have higher stress concentration and thus would be lower in openability when the two have the same residual metal thickness after scoring. It may be considered because the harder and thinner steel sheet can obtain, with less force, the specific deformation which is also required in the vicinity to the scored section in order to cause opening, i.e., fracture at the scored section. Therefore when residual metal thickness can be equalized, the harder and thinner steel sheet which is more disadvantageous in respect of stress concentration at the scored section is advantageous in openability.

Next, the limiting residual metal thickness (minimum residual metal thickness which can be scored without causing any crack at the scored section) will be discussed.

The limiting residual metal thickness of the softer and thicker steel sheet, thinner steel sheet hardened through second cold rolling and thinner steel sheet hardened through the controls of heat treatment and composition of steel were compared.

The results show that the limiting residual metal thickness of softer and thicker steel sheet and thinner steel sheet hardened through second cold rolling are approximately equivalent and relatively small, and also these steel sheets can be scored until they become relatively thin without incurring any cracks, while that of thinner steel sheet hardened through the control of heat treatment and composition of steel is relatively great.

It is assumed that the reason for this is that the softer material can be better scored with greater scoring reduction (sheet thickness of the end minus the residual metal thickness, divided by the sheet thickness of the end) without the occurrence of any cracks, and the thinner sheet thickness of the end will have smaller a scoring reduction when the residual metal thickness is equivalent.

Another reason is that the sheet hardened through second cold rolling will have a smaller limiting residual metal thickness because the microstructure of this steel sheet develops elongated grains (rolling texture) in the longitudinal direction to the sheet surface after second cold rolling and this grain structure is suitable for reduction of the limiting residual metal thickness.

The strength which can withstand load without causing any cracks in the scored section in case of impact e.g. dropping etc. (hereinafter referred to as "impact strength") will now be discussed,.

In this regard, the smaller the residual metal thickness, the smaller the impact strength, but if the residual metal thickness is constant, the results show that the harder and thinner sheet end is greater in impact strength than the softer and thicker sheet end. It may be considered that because the harder and thinner sheet end tends to deform elastically more than the softer and thicker sheet and absorbs impact in the end in its entirety, this reduces stress concentration at the scored section.

Through various experiments pertaining to openability, limiting residual metal thickness or impact strength as necessary for producing an easy open end, it was found that when the yield strength of end material is the same, the thinner sheet hardened through the second cold rolling is superior as a steel sheet for an easy open end can. In this case, when a certain level of hardness must be obtained through second cold rolloing, the lower the hardness of the sheet before second cold rolling, the greater the rolling reduction of the sheet, while the higher the hardness before second cold rolling, the lower the rolling reduction of the sheet.

When comparing two sheets having the same hardness after the second cold rolling, the sheet through second cold rolling with greater rolling reduction results in a smaller limiting residual metal thickness than the sheet through second cold rolling with smaller rolling reduction.

It may be considered because the greater the rolling reduction is, the more the grain forms a microstructure elongated in the longitudinal direction to sheet surface.

Also, the carbon content and the quantity of nonmetallic inclusions have an effect on the limiting residual metal thickness and as the result of testing, this effect is shown by the formula: $C+1{,}000\times P$, where carbon content in ppm is represented by C and cleanliness indicating the quantity of nonmetallic inclusions (d $60\times 400$ . . . %) is represented by P.

Then the greater the value of $C+1{,}000\times P$, the greater the limiting residual metal thickness.

It is advised, however, that this value of $C+1{,}000\times P$ should be determined with respect to hardness before the second cold rolling. For sheets which become harder before the second cold rolling, the value of $C+1{,}000\times P$ must necessarily be smaller, while for those which become softer, a smaller value of $C+1{,}000\times P$ will not be as necessary because the limiting residual metal thickness is to be improved due to considerable elongation of the grain by the second cold rolling.

In fact, unnecessary lowering of the value of $C+1{,}000\times P$ for sheets which become softer after annealing will make the cost of material needlessly higher.

The relation between the limiting residual metal thickness and hardness, carbon content and cleanliness after annealing, and second cold rolling reduction is as above mentioned.

In any event, the upper limit of the second cold rolling reduction should be determined based on a consideration of openability, including the limiting residual metal thickness.

As the rolling reduction becomes greater, the degree of material hardening is lowered, so even when the second cold rolling reduction is made greater than that determined by formula (1), the limiting residual metal thickness will be adversely affected. Moreover, the opening force will be increased with more extremely developed embrittlement of the material than would be obtained by reducing the end thickness due to material hardening or by improving the limiting residual metal thickness due to elongation of grain.

Also, when the second cold rolling reduction is 45% and over, an adverse effect on the embrittlement of material is found to be greater and the limiting residual metal thickness will be increased and the opening force will be increased as well.

Therefore, the lowering of the value of $C+1{,}000\times P$ and lowering of hardness to 45 or more in formula (1) will have almost no effect on the improvement of opening force but will only be unfavorable with respect to cost. For such reasons, the upper limit of second cold rolling reduction is provided.

Also, the lower limit 20% of the second cold rolling reduction is because when rolling reduction is less than 20%, hardening cannot be sufficiently accomplished and so thinning of sheet thickness and elongation of grain suitable for improvement of the limiting residual metal thickness cannot be obtained.

In this connection, hardness after annealing is fixed by the composition of steel, heat treatment condition, etc., which factors are selected with respect to cost, corrosion resistance against contents and others.

However, the second cold rolling reduction after annealing is to be selected according to type of end and type of scoring.

Steel sheet to be manufactured in this way is then subjected to pretreatment including degreasing and pickling and is subjected to the process of tin plating, electro-chrome coating, phosphating and other conversion treatment, to produce steel sheet for easy open end can.

Hereinafter is the description of the embodiments of the invention.

TABLE 1

| | Chemical composition (weight %) | | | | | |
|---|---|---|---|---|---|---|
| Steel | C | Si | Mn | P | Al | Carbon content after decarburization |
| A | 0.010 | 0.01 | 0.33 | 0.018 | 0.081 | |
| B | 0.028 | 0.02 | 0.35 | 0.020 | 0.090 | |
| C | 0.052 | 0.02 | 0.33 | 0.022 | 0.073 | |
| D | 0.051 | 0.02 | 0.32 | 0.022 | 0.075 | 0.0019 (0.0022) |
| E | 0.051 | 0.02 | 0.32 | 0.022 | 0.070 | 0.016 (0.017) |

The steels shown in Table 1 were refined in the converter.

Steel A was decarburized and degassed until the molten steel had the chemical composition shown in Table 1 by vacuum degassing and then was delivered, according to the regular strip process, to ingot making, hot rolling and first cold rolling and followed by either box annealing or continuous annealing.

Steel B was refined by regular refining, except for lower carbon content, including ingot making, hot rolling and first cold rolling and followed by either box annealing or continuous annealing.

Steel C was refined by the regular refining to an average level of carbon content as a steel sheet for cans, including ingot making, hot rolling and first cold rolling and followed by either box annealing or continuous annealing.

Steel D was refined by the same regular refining as steel C up to hot rolling. In the case where continuous annealing is used after first cold rolling, it is decarburized before first cold rolling, in the case where continuous annealing is not used, it is decarburization box annealed after first cold rolling without decarburizing before first cold rolling.

Steel E was produced by the same manufacturing process as steel D, except that decarburization was intentionally ceased earlier to regulate carbon content.

The carbon content of steels D and E after decarburization, shown in Table 1 without a bracket, are values after decarburization following first cold rolling and those shown in the bracket are values after decarburization before first cold rolling.

In the case where the hardness after the first cold rolling is from 40 to 55 in Hr 30T, box annealing or decarburization box annealing was used and in the case where the hardness is from 55 to 65 in Hr 30T, continuous annealing was used.

These steels with thickness and hardness predetermined so that their yield strength can be equalized (thickness squared times yield stress of material can be constant) were then subjected to a second cold rolling.

After the second cold rolling, the steels were cleaned and tin plated in a ferrostan bath and followed by end machining.

The end had a scoring of 58 mm in diameter for the full open end. Rivetting was substituted by soldering to attach a tin plate tab to the end in the same specific place as the production end since it was impractical to manufacture a metal mold to suit a number of thickness that are available.

The acceptance of openability was based on the maximum tearing force subsequent to the initial opening force at residual metal thickness, that is, the limiting residual metal thickness of each material plus 10 μm and the evaluation was done based on a temper of 2.5 (Hr 30T 52 to 58) and sheet thickness of 0.23 mm which are applied as acceptance criteria of the full open end at present. The results are shown in FIG. 1 and FIG. 2: FIG. 1 provides the results related to a hardness of 48 to 53 in Hr 30T before the second cold rolling of sheets which have been annealed by box annealing or decarburization box annealing, and FIG. 2 shows the relation between ($C+1{,}000\times P$) and second cold rolling reduction to openability, with a hardness 58 to 64 in Hr 30T before the second cold rolling of the sheet which has been annealed by the continuous method. The values marked with a triangle in the figures show those which found improvement less than 7.5%, values marked with single circle are those found improvement at 7.5 up to 15% and values with double circle means improvement more than 15%, in respect to the acceptance level (opening force with temper 2.5 and thickness 0.23 mm).

Those which are included in a dotted line in the figures fall under the scope of the invention and show that the harder and thinner steel sheet manufactured in compliance with formulas (1) and (2) (provided that yield strength is constant) finds improvement at more than 7.5% in openability and is superior as an easy open end material. The preferred embodiments herein pertain to tin plate sheets, but other embodiments with surface treatment of not only tin plate but tin-free steel and other conversion treatment steel sheets will find satisfactory improvement as well.

Also, the attachment of tab is not limited to soldering which is referred herein for convenience of the test only, and applications using attachment by bonding as referred in JPI Journal 1984 vol. 22 No. 4 are feasible as well.

Figure 1:
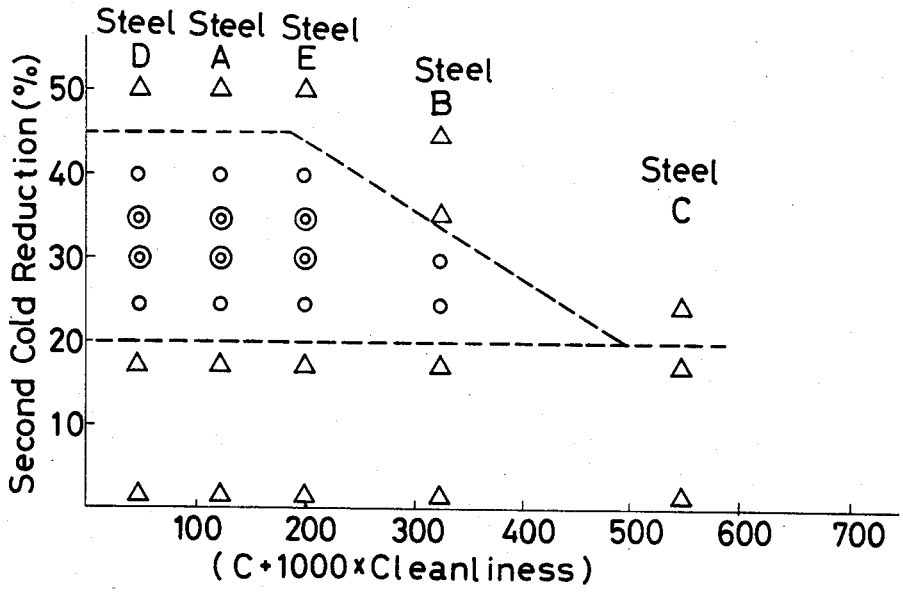
FIG. 1 shows the relation between (carbon content $1{,}000\times$cleanliness) and second cold rolling reduction and openability of the end sheet with a hardness (Hr 30T) in the range of 48 to 53 after annealing.
Figure 2:
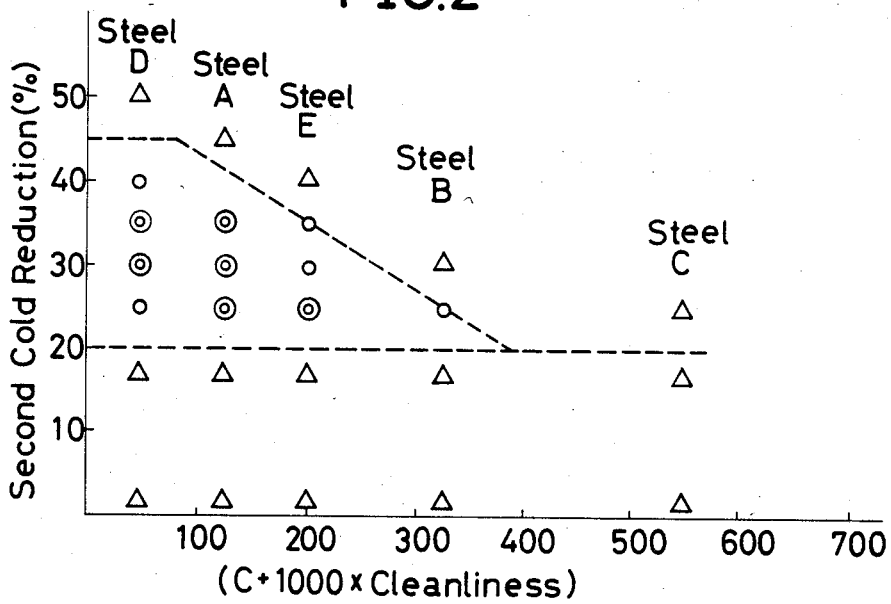
FIG. 2 shows the relation between (carbon content $1{,}000\times$cleanliness) and second cold rolling reduction and openability of the end sheet with a hardness (Hr 30T) in the range of 58 to 64 after annealing.

What is claimed:

1. In a method for the manufacture of steel sheet for easy opening can ends, superior in openability, which method comprises the steps of hot rolling, first cold rolling, annealing and second cold rolling, improvement which comprises performing the second cold rolling according to the formulae $$100-0.08\times(C+1{,}000\times P)-0.8\times H>R>20 \quad (1)$$

and $$45>R \quad (2)$$

, wherein

R: second cold reduction (%)

C: carbon content after annealing (ppm)

P: cleanliness after annealing ($d60\times400$ . . . %)

H: hardness after annealing (Hr 30T).

2. The method according to claim 1 wherein the hardness after the first cold rolling is from 40 to 55 in Hr 30T and box annealing or decarburization box annealing is employed.

3. The method according to claim 1 wherein the hardness after the first cold rollling is from 50 to 65 Hr 30T and continuous annealing is employed.

* * * * *